United States Patent [19]

Fitjer

[11] Patent Number: 5,040,914

[45] Date of Patent: Aug. 20, 1991

[54] DEVICE FOR THE APPLICATION OF COSMETIC MATERIALS

[75] Inventor: Holger Fitjer, Ansbach, Fed. Rep. of Germany

[73] Assignee: Georg Karl Geka-Brush GmbH, Bechhofen-Waizendorf, Fed. Rep. of Germany

[21] Appl. No.: 478,863

[22] Filed: Feb. 12, 1990

[30] Foreign Application Priority Data

Feb. 23, 1989 [DE] Fed. Rep. of Germany ..... 3905580

[51] Int. Cl.[5] ..... A45D 40/00; A45D 40/24

[52] U.S. Cl. ..... 401/127; 401/34; 401/75; 401/81; 401/129; 401/130

[58] Field of Search ..... 401/126, 127, 129, 130, 401/34, 75, 81

[56] References Cited

U.S. PATENT DOCUMENTS

| | | | |
|---|---|---|---|
| 2,219,000 | 10/1940 | Williams | 401/130 X |
| 2,700,371 | 1/1955 | Zahel | 401/75 |
| 3,768,915 | 10/1973 | Spatz | 401/127 X |
| 3,837,749 | 9/1974 | Spatz | 401/130 |
| 4,313,686 | 2/1982 | Proffer | 401/129 X |

FOREIGN PATENT DOCUMENTS

| | | | |
|---|---|---|---|
| 209361 | 1/1987 | European Pat. Off. | 401/127 |
| 0263329 | 4/1988 | European Pat. Off. . | |

*Primary Examiner*—Steven A. Bratlie
*Attorney, Agent, or Firm*—Browdy and Neimark

[57] ABSTRACT

In a device to apply cosmetic materials such as powders, pastes or similar substances by means of an applicator which is held against the surface of the cosmetic material in a storage chamber by spring pressure, it is envisioned that, in order to ensure a reliable and induced transfer of the cosmetic material to the applicator when the two housing parts are pulled apart, the pencil-like device be simple in construction, that the applicator (8) for the cosmetic material (19) be rotatably mounted within the respective housing part (1), and that, under the force of the spring (16) when the two housing parts (1 and/or 2) are separated, the rotatably mounted applicator (8) is revolved relative to the fixed storage chamber (18), while maintaining the surface contact between the applicator (8) and the cosmetic material (19) in the storage chamber (18).

11 Claims, 2 Drawing Sheets

DEVICE FOR THE APPLICATION OF COSMETIC MATERIALS

FIELD OF THE INVENTION

The invention concerns cosmetic material applicators and more particularly a device consisting of two, sleeve-like housing parts which fit into one another to apply cosmetic materials such as powder, paste and similar substances.

BACKGROUND OF THE INVENTION

Devices are known whereby an applicator is positioned in a first housing part in such a manner that this housing part acts as the sleeve for the applicator when a second housing part is pulled off, whereby the cosmetic material to be applied is held in a storage chamber in the second housing part, and whereby, with the first and second housing part in the connected position, the applicator and the storage chamber for the cosmetic material are pressed against one another by means of a spring.

Such a device is known, for example, from the European Patent EP-OS 0,263,329. In this known device, the first and second housing parts can be axially fitted together by means of an annular ring and a corresponding ring flange, whereby the housing parts, which have round cross-sections, can also be rotated relative to one another in this locked condition. The spring force with which the applicator is pressed against the storage chamber, and thus against the surface of the cosmetic material in the storage chamber, ensures that when the two housing parts are separated from one another in order to use the applicator, a minimum amount of cosmetic material remains on the applicator tip. If, however, the device is opened in the usual manner by simply pulling the two housing parts apart, a relatively small amount of cosmetic material generally remains on the applicator tip, so that the applicator will have to be dipped into the cosmetic material again after a short period of time.

SUMMARY OF THE INVENTION

From this standpoint, it is an object of the present invention to produce a device of the initially-described type in such a manner that a quantity of cosmetic material sufficient for longer application is taken up by the applicator before the device is opened, and independent of any conscious, rotating action, whereby the construction can also be made with a relatively small number of components and is therefore to be realized as an economical, throw-away product.

This object is achieved in accordance with the present invention in that the applicator and the storage chamber for the cosmetic material are each mounted in their individual housing parts so as to be able to rotate, and in that the force applied by the spring when the two housing parts are pulled apart turns the rotating applicator or storage chamber with respect to the fixed storage chamber or applicator while maintaining surface-contact between the applicator and the cosmetic material in the storage chamber.

What is achieved thereby is that, with a device of this type, it is no longer necessary to perform a conscious turning motion of the housing parts with respect to one another when they are to be pulled apart, but rather that if, for example, a user wishes to quickly perform a touch-up to her makeup, she will be assured of always having a sufficient amount of the cosmetic material to be applied on the applicator by simply pulling the two housing parts apart.

Preferably the applicator should be equipped with a plunger at its tip which is axially displaceable along a limited distance in the first housing part, whereby the plunger has a twisted, threaded section which passes through a corresponding opening in a transverse wall of the first housing part section, and whereby the plunger is held under spring pressure in the direction of the storage chamber.

When the two housing parts, which are preferably locked together, are separated from one another in an axial direction, this measure results in the spring pressing down on the plunger so that its twisted, threaded section is pressed through the corresponding opening, causing the plunger and the applicator connected to it to perform a rotating movement. Since the plunger can be axially displaced along a certain length in the first housing part, it remains under the force influence of the spring along this stretch despite the axial separation movement of the housing parts, and therefore remains in contact with the surface of the cosmetic material in the storage chamber. Under pressure, the applicator is forced to perform a rotating movement on the surface so that a defined amount of cosmetic material is always scraped off and transferred to the applicator. Despite this advantage, the overall construction remains very simple, whereby it can be realized from parts which can be easily manufactured and assembled from the area of plastics technology.

The spring, which is in the form of a pressure spring, is most advantageously mounted between a transverse wall of the first housing part and a transverse wall connected to the plunger. Thus, the spring, preferably a coil spring, can be simply inserted into this space during assembly without requiring any further anchoring.

In order to limit the axial travel of the plunger, a ring shoulder is preferably mounted in the first housing part to act as a stop together with the transverse wall of the plunger. For this purpose, the same transverse wall used to support the pressure spring can be employed.

In order to keep the manufacturing as simple as possible from the plastics technology point of view, the twisted, threaded section of the plunger is manufactured from a twisted, longitudinally extruded, rectangular piece of plastic. In accordance with this, the corresponding recess in the transverse wall of the first housing part has a rectangular profile. This design has the additional advantage over the initially referred to state of the art in that the two interlocking housing parts need not necessarily have a circular cross-section in order to permit them to be rotated with respect to one another. Instead, the two housing parts can have a rectangular, rounded rectangular or oval cross-section in order to, for example, indicate by this means a preferred direction for holding the applicator to apply the cosmetic material.

The first and second housing parts can be most advantageously constructed of plastic, whereby at least the housing part surrounding the storage chamber may be transparent. In this way it is possible to determine both the color and the quantity of the cosmetic material in the storage chamber.

In another particularly advantageous embodiment, a storage container is located at either end of a common housing, whereby two plungers equipped with applicators are held under opposing spring pressure and are longitudinally displaceable so as to each face a respective storage chamber. This embodiment permits two types of cosmetic materials with different coloration or with different consistencies to be contained in a single, pencil-like device. This allows for the circumstance that modern make-up techniques often require two different color tones, so that it is not necessary to supply two separate sticks which must both be kept in a ladies purse or cosmetic case.

In order to obtain a particularly simple construction, a single spring is located between the rear transverse walls of the two plungers. Since the individual, removable housing parts are axially locked when they are not being used, these walls form a support for the spring when the applicator in the other housing part is being used.

In line with such a simplification of construction, it is also envisioned that the two storage chambers are each located in a separate housing part, and that the two housing parts are connected by a housing part which holds the two plungers. This design permits devices in accordance with the invention with either one or two applicators to be manufactured from practically identical parts, whereby only a separate housing closure piece is required for the single-applicator design or a housing connection piece must be supplied for the dual-applicator design.

In another preferred embodiment, it is envisioned that the applicator is attached to the tip of a plunger which can be axially displaced along a given path, whereby the plunger has a twisted, threaded cross-section which fits into the corresponding threaded section of the first housing part. By employing such corresponding, threaded sections, a larger, relative rotational movement between the applicator and the storage chamber than is possible in the previously described solution can be achieved when the two housing parts are pulled apart.

It is preferable that the threaded section of the plunger is formed by an exterior thread stretching only along two sections which lie opposite to one another, whereby the two threaded sections have a number of threads which will ensure that the threads engage in all, relative, rotational angle positions. When extrusion molding is used in the manufacture of all the components, it permits manufacture to be carried out with a linear mold which does not need to be unscrewed to be opened, as opposed to the more expensive and slower screw-closure molds.

In a further variation it is envisioned that the plunger be connected with a guide section with an exterior, thread-type groove which engages with an axially fixed, wire spiral surrounding the guide section. This solution allows the groove on one hand and the wire spiral on the other to form a practical thread engagement. Such an axially fixed, wire spiral can be relatively easily inserted, avoiding problems during the removal from the mold during the production of the threads.

Further characteristics, advantages and individual points of the invention will be apparent from the following detailed description of a preferred embodiment taken in conjunction with the drawings wherein:

DETAILED DESCRIPTION OF THE PREFERRED EMBODIMENTS

Figure 1:
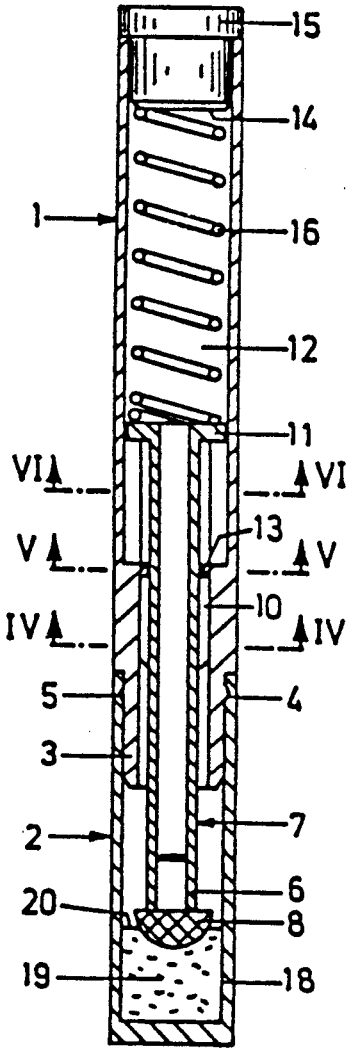
FIG. 1 shows a lengthwise cross-section through a first embodiment of a device in accordance with the invention.
Figure 6:
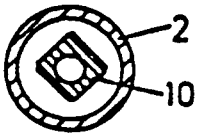
FIG. 6 shows a section along line VI—VI in FIG. 1.

A device shown in FIG. 1 consists of a first housing part 1 made of plastic and a second housing part 2 which is sleeve-like and which is also manufactured from plastic. The second housing part 2 overlaps a section 3 of the first housing part 1 with a reduced, exterior diameter and axially locks onto this section 3 of the first housing part 1 by means of a ring groove 4 formed on the second housing part and a ring flange 5 formed on the section 3 of the first housing part 1 so that the exterior walls of the two housing parts sit flush with one another in this, connected condition.

In the first housing part 1 an applicator 8 in the form of a porous, sponge-like plastic part is attached to the front end 6 of a plunger 7.

Figure 2:
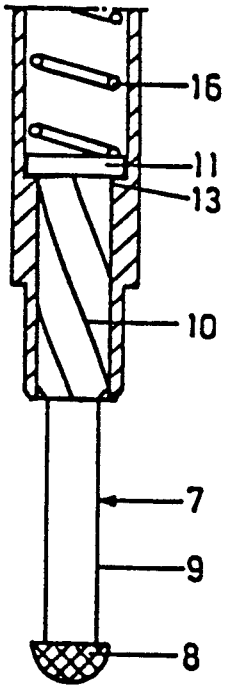
FIG. 2 shows a partial cross-sectional side view of the applicator and the plunger with the second housing part pulled off.

The plunger 7 shown in the side view in FIG. 2 has a smooth, exterior section 9 at the end of the applicator 8 followed by a twisted thread 10. The twisted thread 10 is formed by an extruded piece of plastic with a rectangular cross-section wound or twisted around its longitudinal axis. The rear end of this twisted, threaded section 10 forms a transverse wall 11 which runs across the entire length of the interior free space 12 of the first housing part 1.

The axial interior space 12 is axially closed in the direction of the applicator by an annular ring 13 and in the direction of the used side by a face wall 14 which, in the embodiment example in accordance with FIG. 1 is formed by a closure piece 15 pushed into the first housing part 1. A coil spring 16 is located in the space 12 which presses against the face wall 14 on the one side and, on the other, against the transverse wall 11 of the plunger and therefore pushes this plunger in the direction of the second housing portion 2.

Figure 4:
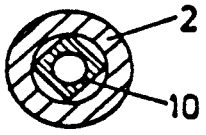
FIG. 4 shows a section along line IV—IV in FIG. 1.
Figure 5:
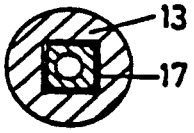
FIG. 5 shows a section along line V—V in FIG. 1.

The annular ring 13 leaves an opening 17 with a rectangular cross-section which can be seen in FIG. 5, whose clear space is somewhat larger than that of the rectangular cross-section of the twisted, threaded section 10. This causes the plunger 7 and therefore the applicator 8 as well to perform a circular movement when the twisted, threaded section 10 of the plunger 7 is moved axially through the recess 17 relative to the first housing part 1.

A storage chamber 18 for a cosmetic material 19 is located in the second housing part 2. When the first housing part 1 and the second housing part 2 are pushed together and interlocked, the pressure action of the spring 16 pushes the applicator 8 against the surface 18 of the cosmetic material 19. When the first and second housing parts are pulled apart, the plunger 7 is pressed downward by the influence of the pressure spring 16, whereby the interaction of the twisted, threaded section 10 with the recess 17 produces a rotational movement so that the applicator 8 carries cosmetic material 19 from the surface 20 because of axial pressure. Thus for the application process possible after the second housing part 2 has been completely separated and for which housing part 1 acts as a handle, the applicator 8 is well covered with cosmetic material. When the first housing part 1 is subsequently placed back onto the second housing part 2, the pressure between the surface 20 of the cosmetic material 19 and the applicator 8 push the plunger 7 upward, simultaneously resulting in another rotational movement of the applicator 8 on the surface 20, thus transferring cosmetic material 19 to the applicator 8 in preparation for the next application.

Figure 3:
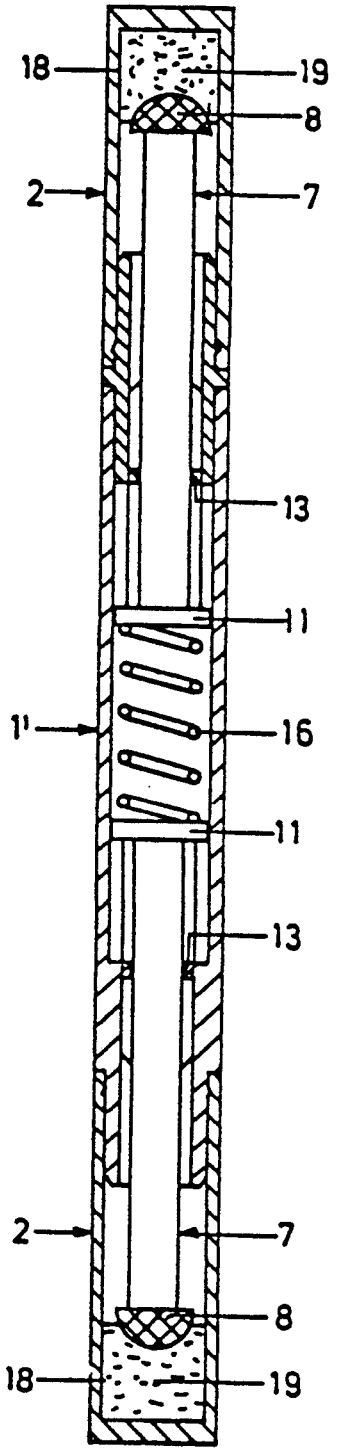
FIG. 3 shows a lengthwise cross-section through a second embodiment with two applicators.
Figure 7:
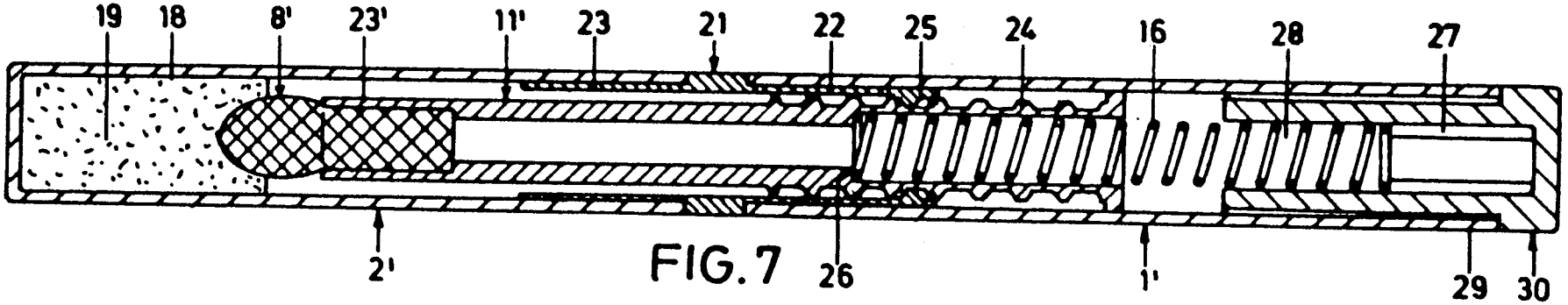
FIG. 7 shows a lengthwise cross-section in accordance with FIG. 1 through an embodiment with two corresponding threaded sections.

In principle, the embodiment shown in FIG. 3 operates in the same manner, whereby the housing part 2 and the plunger 7 are identical in construction to the construction in accordance with FIG. 1. The only difference lies in the fact that the first housing part 1' is not equipped with a closure piece 15, but rather, a second housing part 2 is attached, which surrounds a second plunger 7 and a second applicator 8, for which, accordingly, only one pressure spring is necessary and which acts on both of the plungers 7 simultaneously. Thus, this embodiment can be economically manufactured, since it can be assembled out of parts which are to a great extent identical to those in FIG. This variation permits differing cosmetic materials 19 to be stored in the storage chambers 18, which provides for a variety of application possibilities.

The embodiment shown in FIG. 7 to 10 consists of two, sleeve-like housing parts 1', 2', with the storage chamber 18 for the cosmetic material 19 located in the housing part 2'. The two housing parts 1', 2' are connected by means of an adapter 21, equipped with insertion parts 22, 23 onto which the first housing part 1' and the second housing part 2' are plugged. The first housing part 1' is permanently joined with the adapter 21, so that the latter practically forms a part of the first housing part 1'. In contrast to this, the second housing part 2' is pulled off when the applicator 8' is to be used, and is subsequently plugged on again.

The front end of the plunger 11' is equipped with an applicator 8' made of foam or a similar material and inserted into the front end 23'. An exterior thread 24 is formed at the rear end of the plunger 11', and engages in a threaded section 25 of the adapter 21.

One side of a coil spring 16 presses against a ring shoulder 26 on the inside of the plunger 11', while the other side presses against ribs 27 in the longitudinal recess 28 of a closure cap 30 mounted on the rear end 29 of the first housing part 1'.

When the housing part 2' is pulled off the adapter 21, the spring 16 presses the plunger 11' away from the first housing part 1', thereby, because of the engagement of the threaded sections 24 and 25, causing the plunger 11' and therefor the applicator 8' to rotate relative to the cosmetic material 19 in the storage chamber 18.

Figure 10:
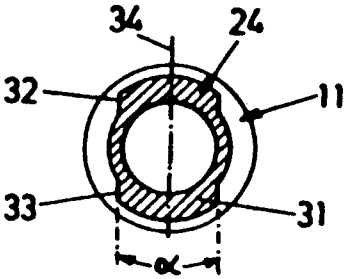
FIG. 10 shows a section along line X—X in FIG. 8.
Figure 8:
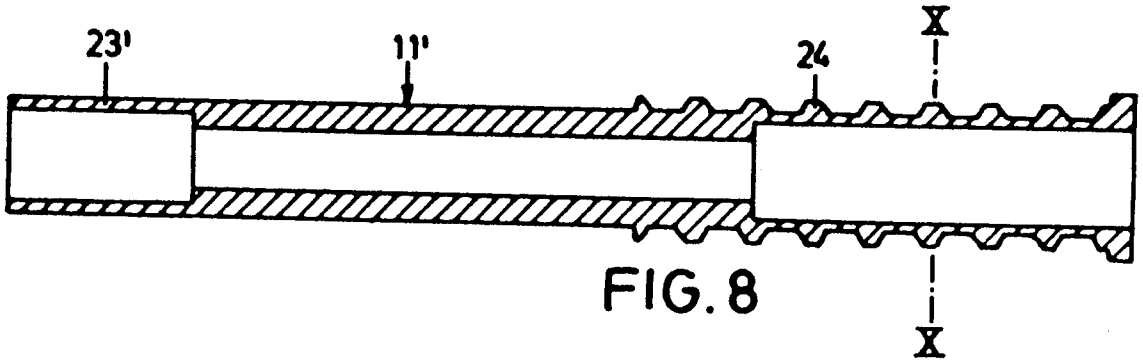
FIG. 8 shows a cross-section through the correspondingly modified form of the plunger.
Figure 9:
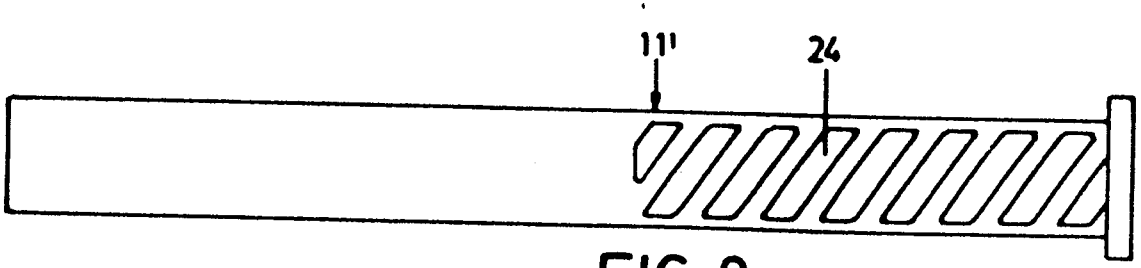
FIG. 9 shows a view of the plunger in accordance with FIG. 8.

The threaded sections 24, 25 are formed in such a way that the parts carrying these threaded sections can be produced in linearly opening molds, thus avoiding the use of screw-closure molds. For this, it is envisioned that the threaded section 24 and/or the individual threads 31 do not extend beyond 360°, but rather, as shown in FIG. 10, that they extend across two opposing angular areas $\alpha$ of approximately 90° each. The severed outside edges 32, 33 of opposing perimeter areas are thus flush with one another, and run parallel to the center line 34 shown in FIG. 10.

Despite the linear mold removal achieved by this construction, it should be ensured that the threaded sections 24, 25 are axially engaged in every relative position, in order to prevent the spring 16 from pushing the plunger 11' out when housing part 2' is pulled off. In a preferred embodiment, this can be accomplished by means of a four-turn thread, having an angle of engagement of 60° and a pitch of 10 mm with a trapezoidal profile.

Preferably, such a threaded section 24 is equipped with four thread turns. Further, a left-hand thread is most advantageously employed so that unconscious right-hand screwing movements which occur when housing parts 1' and 2' are pulled apart do not become effective in reducing the rotational movement, that is, the intended relative movement should add itself to the right-hand screwing movement and should not be reduced by this amount.

An embodiment with two applicators was described in connection with FIG. 3. Such an embodiment can also be achieved in accordance with FIG. 7 to 10 by the use of two, corresponding threaded sections for each, individual applicator. Either a porous, foam material can be employed as an applicator in both cases. On the other hand, it is also possible in such a dual version to have an applicator on one side to apply a powder-like material to broad surfaces, while the other side is equipped with a so-called pencil. For example, one could apply eye shadow with the one applicator while using an contour pencil on the other end to draw outlines. Naturally it is also basically possible to form both the applicators as brushes and to have suitable protective devices for these.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A device to apply cosmetic material such as powders, pastes or similar materials, consisting of two, interlocking, sleeve-like housing parts, wherein the first housing part has an applicator mounted in it in such a manner that this housing part acts as a grip for the applicator when the other, second housing part is pulled off in a merely axial direction, wherein the cosmetic material to be applied is contained in a storage chamber in the second housing part and wherein the applicator and the storage chamber for the cosmetic material are pressed against one another by the action of a spring when the two housing parts are locked together, wherein the applicator (8) is rotatably mounted within said first housing part (1), wherein, under the force of the spring (16) when the two housing parts (1,2) are separated in axial direction, the rotatably mounted applicator (8) is revolved relative to the fixed storage chamber (18), while maintaining the surface contact between said applicator (8) and said cosmetic material (19) in the storage chamber (18), wherein said applicator (8) is located at the tip of a plunger (7) which can be axially displaced along a limited path in the first housing part (1), wherein the plunger (7) is equipped with a twisted, threaded section (10) which is pushed through a corresponding recess (17) in a transverse wall (11) of the first housing section (1), and wherein the plunger (7) is under spring pressure in the direction toward the storage chamber (18) thus pressing said applicator (8) rotatably against the surface of said cosmetic material contained in said storage chamber.

2. A device in accordance with claim 1, characterized in that a pressure spring (16) is located between the transverse wall (face wall 14) of the first housing part (1) and a transverse wall (11) connected to the plunger (7).

3. A device in accordance with claim 1, characterized in that, in order to axially limit the displacement path of the plunger (7) in the first housing portion (1), there is an annular ring (13) which acts as a stop together with the transverse wall (11) of the plunger (7).

4. A device in accordance with claim 1, characterized in that the twisted, threaded section (10) of the plunger (7) consists of a twisted, longitudinally extruded, rectangular plastic piece.

5. A device in accordance with claim 4, characterized in that at least the housing part (2) surrounding the storage chamber (18) is partially transparent.

6. A device in accordance with claim 1, characterized in that the first and second housing parts (1, 2) are manufactured from plastic.

7. A device in accordance with claim 1, characterized in that one storage chamber (19) is located at each outer end of a single, common housing (housing part 2), wherein two plungers (7) equipped with applicators (8) are longitudinally displaceable away from each other by a spring in the direction of a respective storage chamber (18).

8. A device in accordance with claim 7, characterized in that a single pressure spring (16) is located between the rear transverse walls (11) of the two plungers (7).

9. A device in accordance with claim 1, characterized in that the applicator (8') is located at the tip of a plunger (11') which is axially displaceable along a limited path, wherein the plunger (11') is equipped with a threaded section (24) which engages in a corresponding threaded section (25) of an adapter (21) connected axially to said first housing part.

10. A device in accordance with claim 9, characterized in that the threaded section (24) of the plunger (11') is formed by an exterior thread which only stretches longitudinally along two, opposing areas, wherein the two threaded sections (24, 25) have a number of thread turns which ensure thread engagement in every, relative rotational angle position.

11. A device in accordance with claim 1, characterized in that a guide section with an exterior, thread-like groove is connected to the plunger and which engages with an axially fixed wire spiral surrounding the guide section.

* * * * *